US009595782B2

(12) United States Patent
Farole

(10) Patent No.: US 9,595,782 B2
(45) Date of Patent: Mar. 14, 2017

(54) PIN WITH ANGLED RETENTION MEMBER

(71) Applicant: TYCO ELECTRONICS CORPORATION, Berwyn, PA (US)

(72) Inventor: Dominic Anthony Farole, Hummelstown, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 14/818,396

(22) Filed: Aug. 5, 2015

(65) Prior Publication Data

US 2017/0040732 A1 Feb. 9, 2017

(51) Int. Cl.
*H01R 13/40* (2006.01)
*H01R 13/42* (2006.01)

(52) U.S. Cl.
CPC ..... *H01R 13/42* (2013.01)

(58) Field of Classification Search
CPC ..... H01R 13/42; H01R 12/58; H01R 9/091
USPC ..... 439/733.1
See application file for complete search history.

(56) References Cited

U.S. PATENT DOCUMENTS 2,019,049 A 10/1935 Hoke
3,281,760 A 10/1966 Oshima et al.
4,181,387 A * 1/1980 Walters ..... H01R 9/091 29/838
4,557,539 A 12/1985 Zust et al.
4,889,496 A 12/1989 Neidich
5,051,108 A 9/1991 Lincoln
5,897,401 A 4/1999 Fili et al.
6,042,429 A 3/2000 Bianca et al.
6,217,346 B1 * 4/2001 Cubon ..... H01R 12/58 174/256
6,328,576 B1 12/2001 Takahashi
7,249,981 B2 7/2007 Chen
8,702,454 B2 4/2014 Hamada

* cited by examiner

*Primary Examiner* — Jean F Duverne

(57) ABSTRACT

A contact pin includes a retention section having at least one retention member extending radially outward from contact pin. A first portion is angularly offset in the linear direction of the longitudinal axis of the longitudinal body from a second portion. The at least one retention member has a surface which extends outwardly, beyond an outer diameter of a first end section of the contact pin. As the at least one retention member is angled linearly, the displacement of material around the opening of the deformable component causes forces to be applied to the at least one retention member in at least two directions thereby increasing the retention force of the pin in the deformable component. The angularly offset first portion and the second portion cause the retention section and the pin to rotate relative to the opening as the pin is inserted into the opening.

20 Claims, 4 Drawing Sheets

PIN WITH ANGLED RETENTION MEMBER

FIELD OF THE INVENTION

The present invention is directed to contact pins which are used to provide mechanical and/or electrical connections between various bodies or structures. More particularly, the invention relates to improvements to pins having angled retention members to provide further strength and securing forces with respect to their use in members such as connector housings and the like.

BACKGROUND OF THE INVENTION

A plurality of the electrical contacts or contact pins are frequently mounted in an insulative male connector housing, with one end of the contacts extending from the connector housing so as to make mechanical and electrical contact with a female mating connector. In a typical header, contacts or wire pins which normally have a circular or square cross section are staked into round holes in a housing. Retention of the pins in the housing is generally achieved by a press fit between the contact pins and the holes of the connector housing. The contact pins are typically made from bronze, brass, steel, stainless steel, copper alloy or other electrically conductive material and the connector housing is typically made from a plastic or resin type nonconductive material. During the staking process, the holes of the connector housing can become enlarged and deformed due to the negative clearance between the pin, and the perimeter of the holes. This degrades the ability of the connector housing to securely hold the contact pins in their proper position and alignment.

It is known to provide recesses and projections on the longitudinal side surface of contact pins to form a retention portion on the contact pins. These retention portions provide holding power when the contact pin is inserted into a connector housing. The recesses and the projections may be formed by stamping technology in which the projections are forced or extruded outwardly as the recesses or grooves are stamped into the retention portion of the contact pin.

In one known embodiment, the projections of the contact pins are formed by striking the diameter of the contact with chisel-like tools on different sides at the same time (e.g. two or more sides). This action causes four "V" shaped depressions to be produced in the contact. Between the depressions, the projection is raised above the original diameter of the contact. This enlarged portion of the contact pin is used to provide increased press fit between the contact pin and a hole of a connector housing.

Even with the utilization of these known retention sections, the connector industry is plagued by defective connectors due to inadequate retention of the contact pins in their connector housings. Many problems occur in connectors due to loose contact pins. These pins may fall out or move partially out of their intended position causing mechanical and/or electrical failure. Past solutions that have been proposed to solve this problem have included increasing the amount of press fit between the holes of a connector housing and the contact pins. This is accomplished by making the projections larger or the hole smaller. However, this approach has not been effective because it has caused cracking or warpage of the connector housing.

SUMMARY OF THE INVENTION

An embodiment is directed to a contact pin for insertion into an opening of a deformable component. The contact pin includes a longitudinal body having a first section and a second section. A retention section is located between the first and second sections. The retention section includes at least one retention member extending radially outward from the longitudinal body, with the at least one retention member having a first portion proximate the first section and a second portion proximate the second section. The first portion is angularly offset in the linear direction of the longitudinal axis of the longitudinal body from the second portion. The at least one retention member has a surface which extends outwardly, beyond an outer diameter of the first end section. As the at least one retention member is angled linearly, the displacement of material around the opening of the deformable component causes forces to be applied to the at least one retention member in at least two directions, thereby increasing the retention force of the pin in the deformable component.

An embodiment is directed to a contact pin for insertion into an opening of a connector housing. The contact pin includes a first section and a second section, with a retention section located between the first and second sections. The retention section includes at least one fin extending radially outward from a longitudinal axis of the contact pin, with the least one fin having a first portion proximate the first section and a second portion proximate the second section. The first portion is angularly offset from the second portion in the linear direction of the longitudinal axis of the contact pin. The at least one fin has a portion which extends outwardly, beyond an outer diameter of the first end section. As the at least one fin is angled linearly, the displacement of material around the opening of the connector housing causes forces to be applied to the at least one fin in at least two directions thereby increasing the retention force of the pin in the connector housing.

An embodiment is directed to a contact pin for insertion into an opening of a deformable component. The contact pin includes a first section with a retention section located proximate the first section. The retention section includes at least two retention members extending radially outward from a longitudinal axis of the contact pin, the least two retention members having first portions proximate the first section and second portions spaced from the first section, the first portions being angularly offset from the second portions in the linear direction of the longitudinal axis of the contact pin. The at least two retention members having portions which extend outwardly, beyond a diameter of the opening of the deformable component, the portions engaging walls of the opening when the contact pin is inserted into the opening. As the at least two retention members are angled linearly, the displacement of material around the opening of the deformable component causes forces to be applied to the at least two retention members in at least two directions thereby increasing the retention force of the retention section of the pin in the opening of the deformable component.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
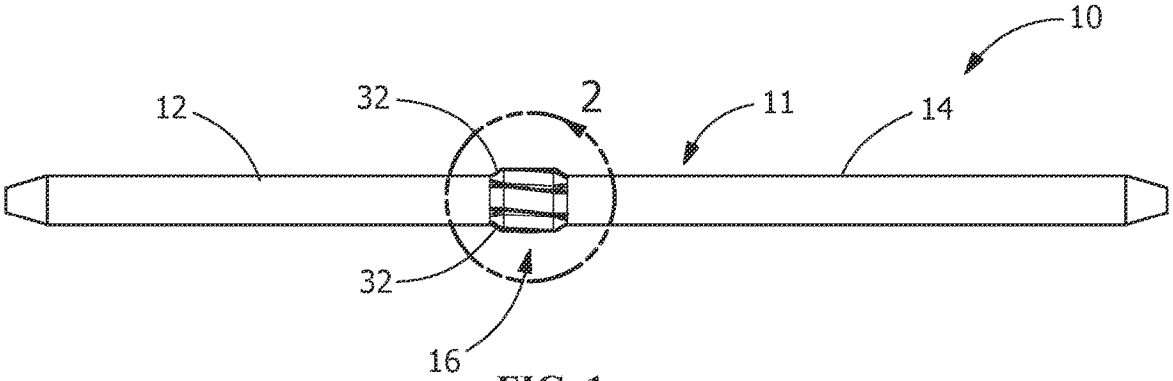
FIG. 1 is a perspective view of an illustrative contact pin having a retention section according to the invention.

The present invention will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that spatially relative terms, such as "top," "upper," "lower" and the like, may be used herein for ease of description to describe one element's or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "over" other elements or features would then be oriented "under" the other elements or features. Thus, the exemplary term "over" can encompass both an orientation of over and under. The device may be otherwise oriented (rotated 90 degrees or at other orientations) and the spatially relative descriptors used herein interpreted accordingly.

FIG. 1 illustrates an illustrative cylindrical contact pin 10 having a longitudinal body 11 having a first end section 12 and a second end section 14. Between the first and second end sections 12, 14 is a retention section 16 for holding the contact pin 10 in a hole of a connector housing (not shown) or a printed circuit board (not shown). In the illustrative two embodiment shown, the retention section 16 includes two legs or fins 18 each having a smooth edge surface 20 located between the first and second end sections 12, 14 and two opposing side surfaces 22 which extend radially outwardly from the longitudinal axis of the cylindrical contact pin 10. As is best shown in FIG. 2, the edge surfaces 20 extend outwardly to form a relatively smooth surface with the outside surfaces of the first and second end sections 12, 14.

In the illustrative embodiment, the retention section 16 also includes two legs, fins or retention members 24 each having a projecting edge surface 26 located between the first and second end sections 12, 14 and two opposing side surfaces 28 which extend radially outwardly from the longitudinal axis of the cylindrical contact pin 10. As is best shown in FIG. 2, portions of the retention members 24, including the edge surfaces 26 extend outwardly, beyond the outer diameter of the first end section 12, the second end section 14 or both the first and second end sections 12, 14, so as to form projecting surface between the first and second end sections 12, 14. "V" shaped channels 30 are formed between side surfaces 28 of retention members 24 and adjacent side surfaces 22 of adjacent legs 18. Although the legs 18, the retention members 24, the edge surfaces 20, 26 and the channels 30 have been illustrated with specific geometric shapes, it should be understood that modifications of these shapes are contemplated within the scope of the invention described herein. The legs 18, the retention members 24, the edge surfaces 20, 26 and the channels 30 are formed by swaging, coining or stamping technology, which is well-known in the art and in which the retention members 24 are forced or extruded outwardly as the channels 30 are swaged, coined or stamped into the retention portion 16 of the circular contact pin 10. This swaging or stamping process may include the step of striking the diameter of the cylindrical contact pin 10 with a preformed die pattern which acts like a chisel to deform the diameter of the contact pin into a desired shape. In the illustrative embodiment shown, the retention section 16 of the cylindrical contact pins 10 are manufactured by striking a round wire, typically made of copper or bronze, on different sides of its diameter at the same time. Such striking or forming may occur, but is not limited to, on two sides or four sides.

Figure 2:
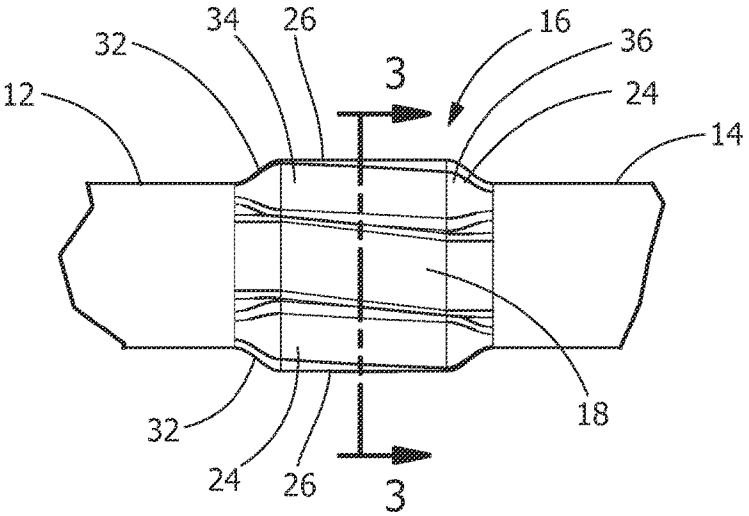
FIG. 2 is an enlarged side view of the retention section of FIG. 1.

As shown in FIG. 2, the retention members 24 may be formed to provide ramped or lead-in surfaces 32 on either side of the retention members 24 proximate the first and second end sections 12, 14. These retention members 24 are formed during the stamping process described above. These lead-in surfaces 32, formed on the edge surfaces 26 of the retention members 24, provide tapered surfaces which allow the pin 10 to be more easily inserted into the opening of the connector housing.

Figure 3:
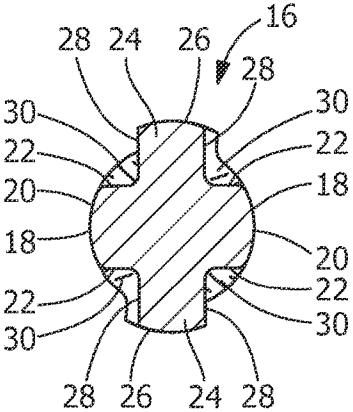
FIG. 3 is a cross-sectional view of the retention section taken along lines 3-3 of FIG. 2.

As best shown in FIGS. 2 and 3, the legs 18 and the retention members 24 are formed to be angularly offset in the linear direction of the longitudinal axis of the pin 10. In the embodiment shown, each of the legs 18 and retention members 24 has the same or similar angular offset to its adjacent leg 18 or retention members 24. In one exemplary embodiment, the portions 34 of the retention members 24 which are proximate the first end section 12 may be offset angularly from the portions 36 of the retention members 24 which are spaced from the first end section 12 and positioned proximate the second end section 14 of the pin 10. In the illustrative embodiment shown, the portions 34 are offset linearly from the portions 36 by approximately 15 degrees. However, other angles of offset, such as, but not limited to, between 5 degrees and 30 degrees, between 10 degrees and 20 degrees, over 10 degrees, less than 45 degrees may be used without departing from the invention.

As the contact pin 10 is inserted into an opening or hole 40 of a housing 42 of a deformable component or connector 43 or PCB, the lead-in surfaces 32 engage the wall 44 of the opening 40. The lead-in surfaces 32 of the retention members 24 cooperate with the wall 44 to properly position the contact 40 in line with a longitudinal axis of the opening 40. The tapered lead-in surfaces 32 also allow for less insertion force to be required as the retention section 16 is initially inserted into the opening 40.

Figure 4:
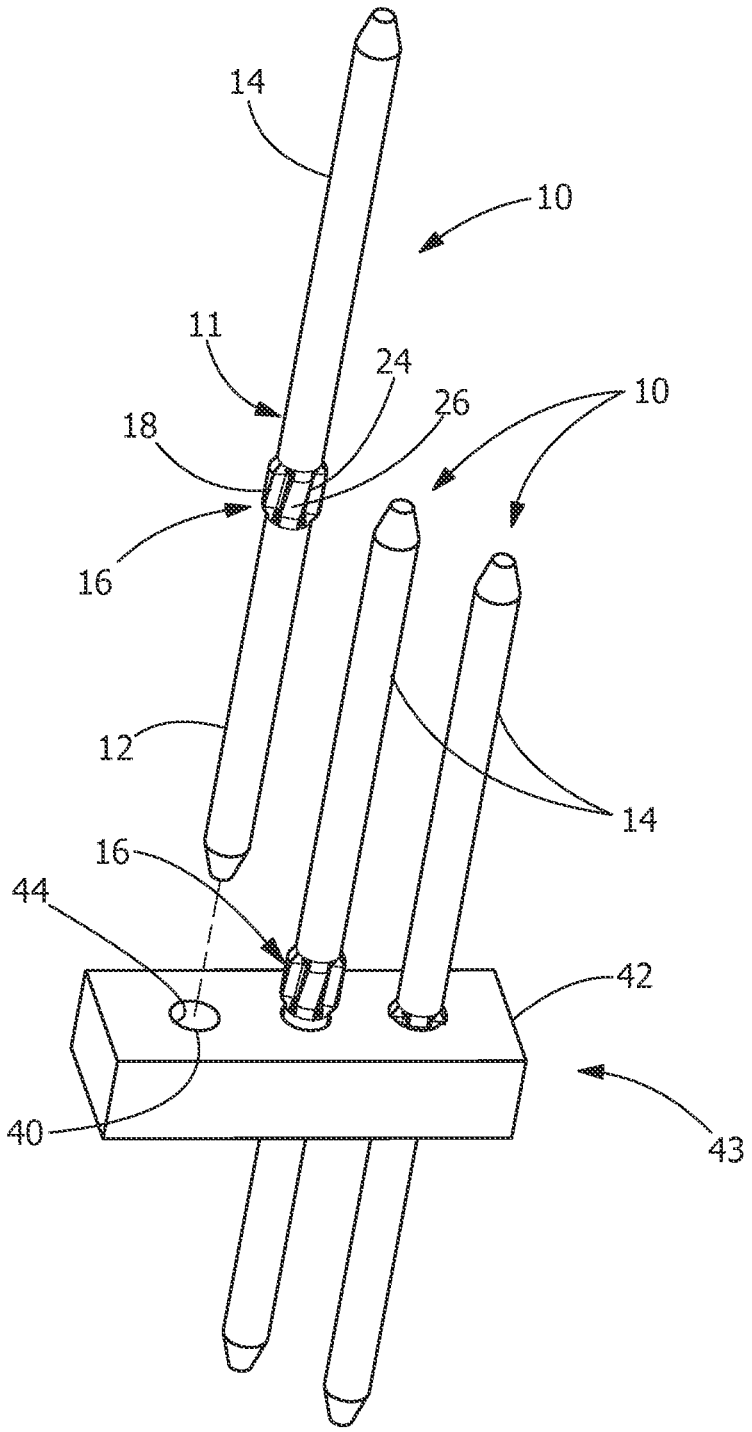
FIG. 4 is a perspective view of several contact pins shown relative to an illustrative deformable member or housing, the contact pins being shown in various stages of insertion.
Figure 5:
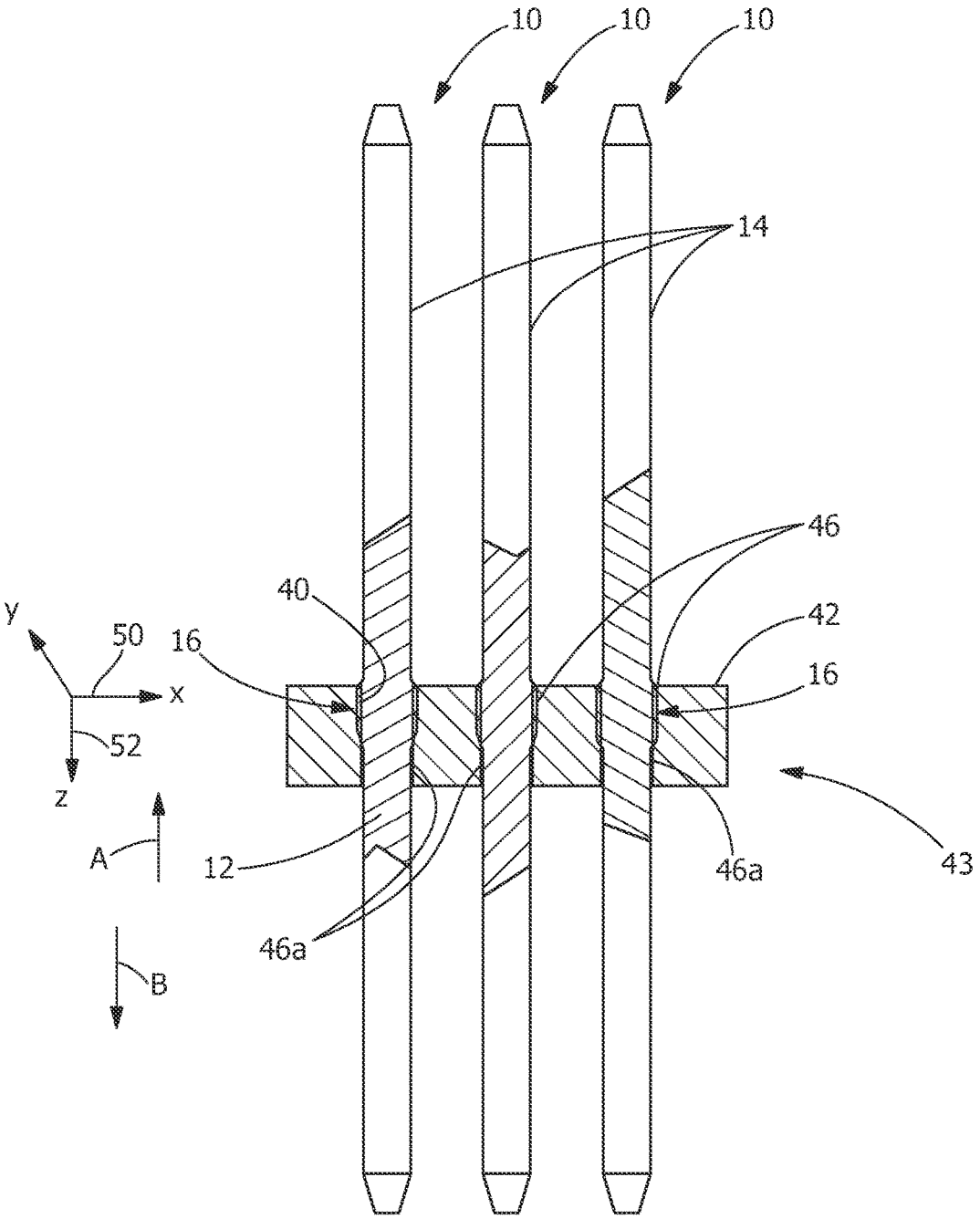
FIG. 5 is a partial cross-sectional view, taken along the longitudinal axis of the contact pins, the contact pins being fully inserted into the deformable member.
Figure 6:
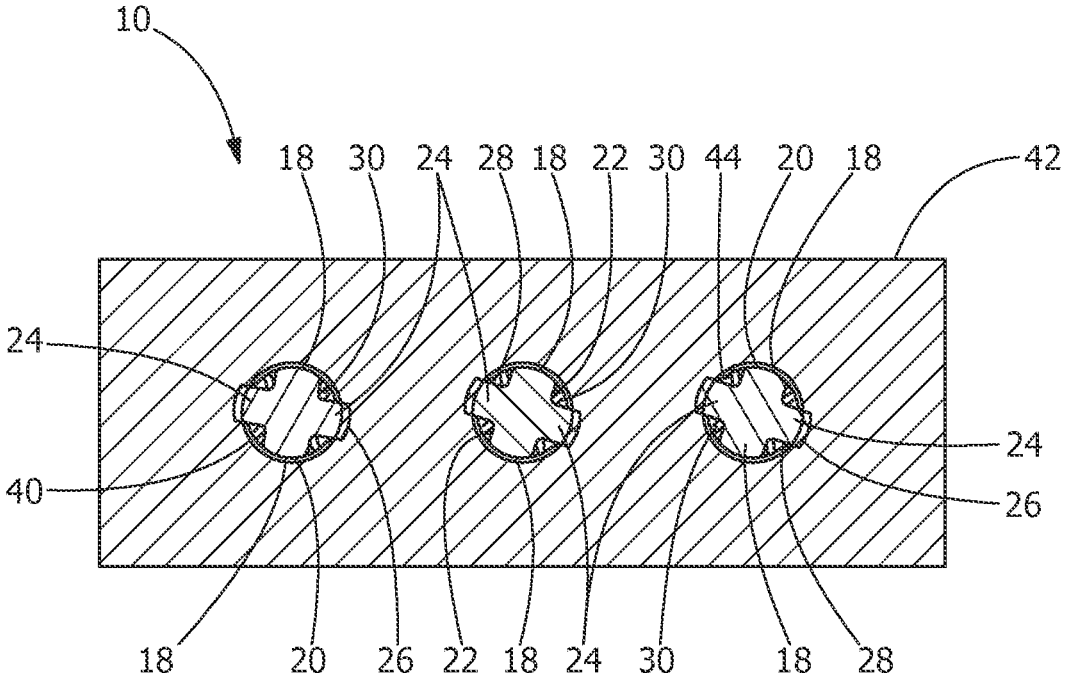
FIG. 6 is a partial cross-sectional view, taken along a plane with is perpendicular to the longitudinal axis of the contact pins, the contact pins being fully inserted into the deformable member.

As insertion continues, edge surfaces 26 of the retention members 24 engage the wall 44 of the opening 44. As each of the edge surfaces 26 of the retention members 24 extend beyond the diameter of the first and second end sections 12, 14 of the pin 10 and beyond the diameter of the opening 40, the edge surfaces 26 of the retention members 24 interferes with the plastic of the housing 42, as the retention section 16 is moved into the opening 40. In the illustrative embodiment shown, the retention members 24 dig in or displace material from the wall 44 of the opening. As insertion continues, the linear angling of the edge surfaces 26 in combination with the wall 44 may cause the pin 10 to rotate or twist slightly. However, whether the pin 10 is rotated or not, material around the wall 44 is displaced by the retention members 24. Insertion continues of the pin 10 into opening 40 until the retention section 16 is properly positioned in the opening 40, as is illustrated in FIGS. 4 through 6. In various embodiments, it is not required that the retention section 16 be fully inserted into opening 40. However, retention section 16 must be inserted a sufficient distance to allow the retention members 24 to interact with the wall 44 to provide the necessary retention force required.

As best shown in FIGS. 5 and 6, with the retention section 16 of pin 10 properly inserted into opening 40, the retention section 16 cooperates with the wall 44 to maintain the pin in position. As the retention members 24 are angled linearly, more surface area is provided between the retention members 24 and the material of the housing 42, thereby increasing the frictional engagement therebetween. As the retention members 24 are angled linearly, the displacement of the material of the housing causes forces to be applied to the retention members 24 in at least two directions (e.g. longitudinally with the pin and angularly with respect to the longitudinal axis of the pin, including, but not limited to, perpendicular to the pin). In the embodiment shown, the forces are applied in both the z-direction as indicated by arrows 50 and in the x-direction as indicated by arrows 52. This combination of forces increases the retention force, thereby making it more difficult to inadvertently remove the pin 10 from the opening 40. If the pin is pulled linearly in the direction of arrow A, the retention forces indicated by arrows 50, 52 resist the linear extraction. The increase in retention force compared to pins having linear, non-angled retention section is greater than 20%, greater than 30%, greater than 40%, greater than 50%.

If the pin is pulled linearly in the direction of arrow B, the retention forces indicated by arrows 50, 52 resist the linear extraction, as previously described. The increase in retention force compared to pins having linear, non-angled retention section is greater than 20%, greater than 30%, greater than 40%, greater than 50%. In addition, as the pin 10 is pulled in the same direction as the insertion of the pin 10 into opening 40, the retention section 16 must be pulled through virgin or non-deformed material section 46 of the housing 42. Portions 46*a* of the virgin material remain present because the retention members 24 of the retention section 16 do not deform the section 46 during insertion. Therefore, the forces associated with extracting or pulling the pin 10 from the opening 44 in the direction of arrow B are larger than the forces associated with extracting or pulling the pin 10 from the opening 44 in the direction of arrow A.

In the illustrative embodiment shown, the first end sections 12 of pins may be soldered to a board or substrate, while the second end sections 14 are configured to mate with mating pins of a mating connector. In most circumstances, any unwanted motion of the housing 42 relative to the pins 10 is in a direction away from the substrate, such as in the direction of arrow B. Therefore, the increased retention force in the direction of arrow B, as described above, provides additional protection against the housing from being moved away from the substrate. Therefore, it may beneficial to insert the pins 10 into opening in a direction toward the mating substrate or the like.

While the retention members 24 of the retention section 16 will initially expand the hole, the "memory" or resilience of the material of the connector housing wall, which defines the perimeter of the hole, will cause portions of the wall of the connector that are not forced outwardly by the edges 26 to partially reform or settle back to some extent into the channels 30 of the retention portion 16, increasing the surface contact between the retention members 24 and the material of the housing 42, thereby increasing the retention force.

In the illustrative embodiment, two fins or retention members 24 are provided in the retention section 16 of the contact pin 10. However, it should be understood that the number, shape and size of the retention members may be varied and still remain within the scope of the present invention. For example, at least one fin or retention member 24 may be provided or three or more fins or retention members 24 may be provided. It should also be noted that the length of the retention portion 16 on the pin 10 may also be varied without affecting the scope.

While the pin 10 and retention section 16 have been shown and described with respect to the mechanical retention of the pin 10 in housing 42, the retention section 16 may also be used to affect the mechanical and electrical connection to a plated through-hole of a circuit board (not shown).

The fins or retention members 24 are formed during a swaging or stamping process by a die which swages or stamps a contact, pin or wire (round, square or rectangular), or strip metal, to form the desired shape of the retention section 16. The contact, pin or wire used may include, but is not limited to, all grades of bronze, brass, steel, stainless steel, copper alloy or any other material used in a connector to conduct electricity. The die may be precision made from carbide metal or other suitable material, which is much harder than the material of the contact, pin or wire, such that the die may easily compress and reform the material of the contact, pin or wire into a desired shape.

In addition due to the increased retention force provided by the retention section 16, the size of the of the retention section 16 may be able to be reduced. If a given retention force is required, the increase in retention force associated with the linearly angled retention members allows for smaller retention members to be swaged, stamped or coined on the contact pin while providing a push out resistance at least equal to a larger known linear fin. Thus, the linearly angled fin or retention member of the present invention can provide a smaller retention section which reduces the amount of cracking or deformation of the plastic connector housing. As should be apparent, another benefit of a smaller retention section is that it allows for a tighter configuration of pins in a connector housing. Furthermore, since the smaller linearly angled fin or retention member reduces cracking and deformation of the plastic of a connector housing, the use of lower quality, or less costly, types of plastic may be used when making the connector housings.

The use of the angled retention members 24 also reduces cracking of the housing 42. As known pins with linear fins are inserted into the openings of the housing, the entire length of the fins may be positioned in the same cross-sectional plane, thereby reducing the space provided between the fins of the pins, which reduces the width of the housing material provided between the pins. This reduction in material can cause the housing material between the openings to be weakened and prone to cracking or other deformation or failure. In the present invention, the length of the angled retention members 24 do not align in the same cross-sectional plane. Consequently, the housing material provided between the openings 40 is not reduced for the entire length of the retention members 24, allowing the material of the housing 42 between the openings 40 to be maintained, thereby reducing the possibility of cracking or failure of the housing.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A contact pin for insertion into an opening of a deformable component, the contact pin comprising:

a longitudinal body having a first section and a second section;

a retention section located between the first and second sections, the retention section comprising:

at least one retention member extending radially outward from the longitudinal body, the at least one retention member having a first portion proximate the first section and a second portion proximate the second section, the first portion being angularly offset in the linear direction of the longitudinal axis of the longitudinal body from the second portion;

the at least one retention member having a surface which extends outwardly, beyond an outer diameter of the first end section to displace material from a wall of the opening; and wherein as the at least one retention member is angled linearly, the displacement of material around the opening of the deformable component causes forces to be applied to the at least one retention member in at least two directions thereby increasing the retention force of the pin in the deformable component.

2. The contact pin of claim 1, wherein the at least one retention member is two fins, with each fin having an edge surface and two opposing side surfaces.

3. The contact pin of claim 2, wherein two legs are positioned between the two fins and channels are provided between respective legs and respective fins.

4. The contact pin of claim 1, wherein the at least one retention member is four fins, with each fin having an edge surface and two opposing side surfaces.

5. The contact pin of claim 1, wherein the at least one retention member has lead-in surfaces provided proximate the first section, proximate the second section or proximate both the first section and the second section.

6. The contact pin of claim 1, wherein the at least one retention member is stamped, coined or swaged from the longitudinal body of the contact pin.

7. The contact pin of claim 1, wherein the at least one retention member has a smooth outer edge surface.

8. The contact pin of claim 1, wherein the first portion of the at least one retention member is angularly offset from the second portion between 5 degrees and 45 degrees in the linear direction of the longitudinal axis of the longitudinal body.

9. The contact pin of claim 1, wherein the first portion of the at least one retention member is angularly offset from the second portion between 10 degrees and 30 degrees in the linear direction of the longitudinal axis of the longitudinal body.

10. The contact pin of claim 1, wherein the angularly offset first portion and the second portion cause the retention section and the pin to rotate relative to the opening as the pin is inserted into the opening.

11. A contact pin for insertion into an opening of a connector housing, the contact pin comprising:

a first section and a second section;

a retention section located between the first and second sections, the retention section comprising:

at least one fin extending radially outward from a longitudinal axis of the contact pin, the least one fin having a first portion proximate the first section and a second portion proximate the second section, the first portion being angularly offset from the second portion in the linear direction of the longitudinal axis of the contact pin;

the at least one fin having a portion which extends outwardly, beyond an outer diameter of the first end section to displace material from a wall of the opening; and wherein as the at least one fin is angled linearly, the displacement of material around the opening of the connector housing causes forces to be applied to the at least one fin in at least two directions thereby increasing the retention force of the pin in the connector housing.

12. The contact pin of claim 11, wherein the at least one fin has lead-in surfaces provided proximate the first section, proximate the second section or proximate both the first section and the second section.

13. The contact pin of claim 11, wherein the at least fin is stamped, coined or swaged from the longitudinal body of the contact pin.

14. The contact pin of claim 11, wherein the at least one fin has a smooth outer edge surface.

15. The contact pin of claim 11, wherein the angularly offset first portion and the second portion cause the retention section and the pin to rotate relative to the opening as the pin is inserted into the opening.

16. A contact pin for insertion into an opening of a deformable component, the contact pin comprising:

a first section;

a retention section located proximate the first section, the retention section comprising:

at least two retention members extending radially outward from a longitudinal axis of the contact pin, the least two retention members having first portions proximate the first section and second portions spaced from the first section, the first portions being angularly offset from the second portions in the linear direction of the longitudinal axis of the contact pin;

the at least two retention members having portions which extend outwardly, beyond a diameter of the opening of the deformable component, the portions engaging walls of the opening when the contact pin is inserted into the opening to displace material from the walls of the opening; and wherein as the at least two retention members are angled linearly, the displacement of material around the opening of the deformable component causes forces to be applied to the at least two retention members in at least two directions thereby increasing the retention force of the retention section of the pin in the opening of the deformable component.

17. The contact pin of claim 16, wherein the at least two retention members have lead-in surfaces provided proximate the first section.

18. The contact pin of claim 17, wherein the at least two retention members are stamped, coined or swaged from the longitudinal body of the contact pin.

19. The contact pin of claim 18, wherein the first portion of each of the least two retention members are angularly offset from the second portion between 5 degrees and 45 degrees in the linear direction of the longitudinal axis of the longitudinal body.

20. The contact pin of claim 16, wherein the angularly offset first portion and the second portion cause the retention section and the pin to rotate relative to the opening as the pin is inserted into the opening.

* * * * *